United States Patent [19]

Foust

[11] 4,276,927

[45] Jul. 7, 1981

[54] PLATE TYPE HEAT EXCHANGER

[75] Inventor: Harry D. Foust, Dakota, Minn.

[73] Assignee: The Trane Company, La Crosse, Wis.

[21] Appl. No.: 45,547

[22] Filed: Jun. 4, 1979

[51] Int. Cl.[3] ..... F28F 3/10; F28F 19/00

[52] U.S. Cl. ..... 165/70; 165/134 R; 165/166

[58] Field of Search ..... 165/70, 134 R, 166, 165/167, 174

[56] References Cited

U.S. PATENT DOCUMENTS

| | | | |
|---|---|---|---|
| 3,190,352 | 6/1965 | Simpelaar | 165/134 R |
| 3,239,002 | 3/1966 | Young | 165/134 |
| 3,825,061 | 7/1974 | Bathla | 165/70 |
| 3,992,168 | 11/1976 | Toyama et al. | 165/166 |
| 4,103,738 | 8/1978 | Aydelott et al. | 165/178 |

FOREIGN PATENT DOCUMENTS

| | | | |
|---|---|---|---|
| 5232159 | 3/1977 | Japan | 165/134 R |
| 568567 | 4/1945 | United Kingdom | 165/152 |
| 585192 | 1/1947 | United Kingdom | 165/134 R |
| 634608 | 3/1950 | United Kingdom | 165/174 |

OTHER PUBLICATIONS

Compact Heat Exchangers for Sea Thermal Power Plants, Anderson et al., Proceedings of the Fourth Annual Conference on Ocean Thermal Energy Conversion, Mar. 1977, pp. V13–14.

*Primary Examiner*—Sheldon J. Richter
*Attorney, Agent, or Firm*—Carl M. Lewis; Peter D. Ferguson; Ronald M. Anderson

[57] ABSTRACT

A plate type heat exchanger is disclosed having flow passages extending beyond the area of heat transfer on at least one end. The extending ends of the flow passages serve as sacrificial inlets for flow of one of two fluids through the heat exchanger so that any leak resulting from flow erosion or from corrosion in the extending flow passages does not result in mixing of the two fluids.

7 Claims, 5 Drawing Figures

FIG. 2
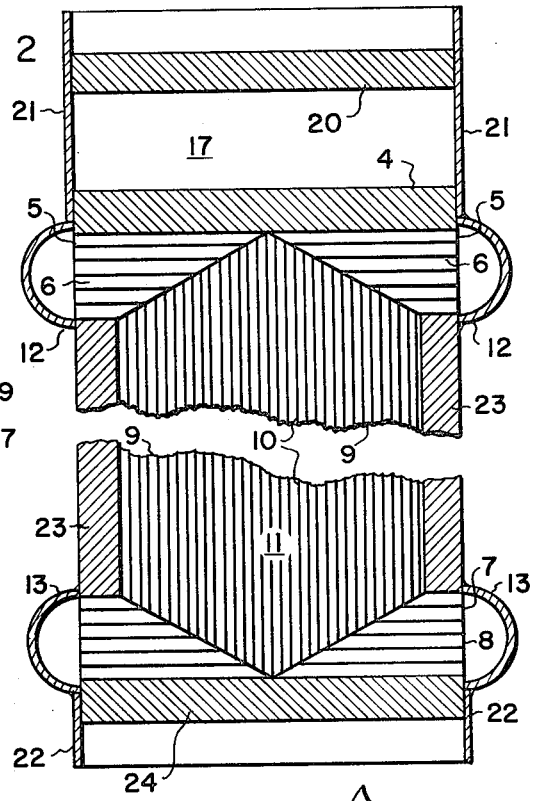
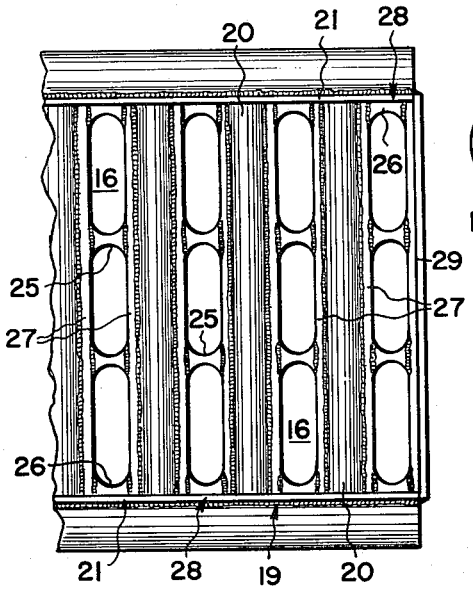
FIG. 5
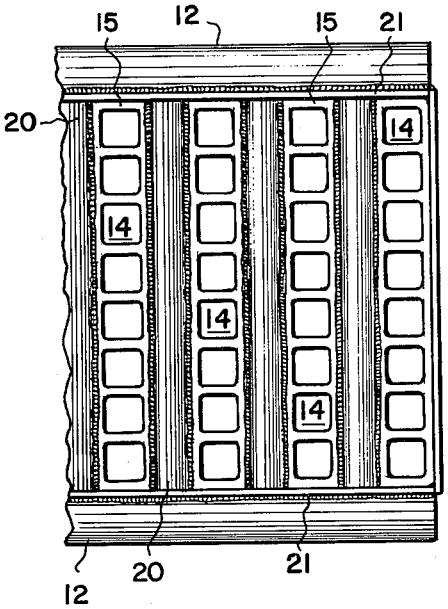
FIG. 4
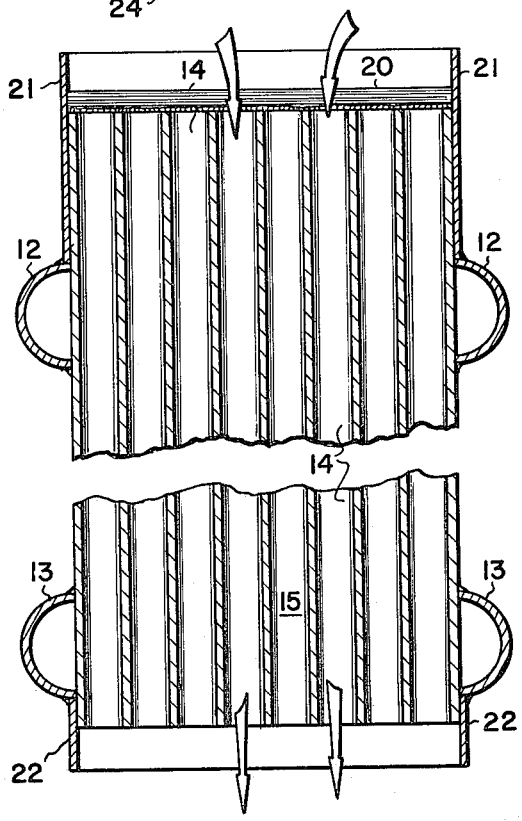
FIG. 3

PLATE TYPE HEAT EXCHANGER

DESCRIPTION

Technical Field

The subject invention is concerned generally with plate type heat exchangers, and specifically, with plate type heat exchangers for effecting heat transfer between salt water and a refrigerant fluid.

The U.S. Department of Energy has established a program to investigate ideas directed to Ocean Thermal Energy Conversion (OTEC). The OTEC concept seeks to generate electrical energy by utilizing the temperature differences between ocean water heated at the surface by solar irradiation, and cooler water from the ocean depths. Proposals for tapping this potential energy source generally use a low efficiency Rankine cycle, involving heat transfer between ocean salt water and a refrigerant fluid.

The warm surface and cool sub-surface ocean water typically differ in temperature by a maximum of about 40° F. Since the extremes of water temperature differ by such a small magnitude, relatively high efficiency, low cost heat exchangers must be used if electrical energy generation from this source is to be commercially viable. It has been suggested that a plate type heat exchanger made from brazed aluminum might meet these requirements (Ref: *Compact Heat Exchangers For Sea Thermal Power Plants*—J. H. Anderson, Sr. and J. H. Anderson, Jr., 1971).

In another proposed application, a plate type heat exchanger has been suggested for boiling liquified natural gas (LNG). Natural gas is most efficiently transported by tankers to coastal ports in liquid form; however, it must be converted to a vapor for transmission, storage, and use. Typically, part of the natural gas is burned to vaporize the LNG. An efficient brazed aluminum heat exchanger could eliminate this waste by using the free heat contained in readily available ocean water to boil the LNG.

In either application, several problems unique to the design of a brazed aluminum heat exchanger for use in an ocean salt water environment should be considered. For example, biological fouling of the flow passages through the heat exchanger by crustacea, algae and other sea life is likely to occur unless sufficiently high salt water flow velocity is maintained. The salt water flow passages should therefore be designed to offer minimum flow resistance.

Since salt water readily corrodes aluminum not protected by a layer of controlled oxidation, e.g., by anodizing, or other coating, it is important that the high flow velocity necessary to avoid bio-fouling not erode the protective coating. The erosion of the protective coating is most likely to occur where turbulent flow impinges on the coated or oxidized surfaces, such as at the inlet to the salt water flow passages of the heat exchanger. A leak at this point in a conventional plate type heat exchanger could allow salt water to mix with the refrigerent fluid, with damaging consequences to pumps or compressors.

For the same reason, the brazed aluminum joints used in the internal construction of the heat exchangers should be protected from direct contact with salt water. In addition, the salt water flow passage should be shaped to facilitate inspection and cleaning, and to eliminate corrosion inducive crevices.

The present invention is designed with consideration of the problems described above, and uses an innovative structure wherein a sacrificial inlet dissipates the entrance turbulence of salt water flow through the heat exchanger, thereby extending its useful service life.

BACKGROUND ART

The following U.S. Patents describe prior art relevant to the subject invention.

U.S. Pat. No. 4,103,738 discloses a heat exchanger having a plurality of replaceable tubes disposed in a bulk-head at the inlet side of the heat exchanger, which tubes are adapted to be readily replaced after sustaining excessive wear due to flow of a fluid containing an abrasive.

A leak protected heat exchanger is disclosed in U.S. Pat. No. 3,825,061 in which headers at opposite ends of flow passages through a heat exchanger form leak chambers which are drained by connected tubing to prevent mixing of a first and a second fluid should a joint failure occur. The flow passages extend from the core and through the leak chambers at each end of the heat exchanger.

DISCLOSURE OF THE INVENTION

The subject invention is a plate type heat exchanger for transferring heat between two fluids of differing temperature. First and second means define separate flow passages through the heat exchanger for the two fluids such that generally planar layers of flow passages defined by the first means alternate with generally planar layers of flow passages defined by the second means. On at least one end, the flow passages defined by the second means extend substantially beyond the flow passages defined by the first means.

Distribution manifold means distribute one of the fluids into the flow passages defined by the first means, and collection manifold means collects the fluid as it exits the flow passages.

The other fluid is channeled by inlet means into the extending ends of the flow passages defined by the second means. Sealing means are provided between ends of adjacent layers of the extending flow passages, so that if a leak should occur in the inlet or extending portions of these flow passages, the two fluids will not mix. Flange means and outlet means respectively direct the other fluid into the inlet means and collect it as it exits the flow passages defined by the second means.

An object of this invention is to extend the service life of a plate type heat exchanger, and specifically, one in which salt water is one of two fluids involved in heat transfer.

Another object of this invention is to provide a relatively efficient, low cost heat exchanger which is easy to clean, minimizes the occurrence and affects of corrosion and flow erosion, and is less likely to experience serious bio-fouling in an ocean salt water environment.

Still a further object of this invention is to reduce the likelihood of the mixing of two fluids separately flowing through a plate type heat exchanger due to a leak developing near the inlet to flow passages for one of the fluids, said leak resulting from turbulent flow erosion and corrosion at the inlet.

These and other objects of the present invention will become apparent from the following description of two preferred embodiments and by reference to the accompanying drawings.

BRIEF DESCRIPTION OF THE DRAWINGS

FIG. 2 is a longitudinal cross-sectional view of that embodiment, taken along section line 2—2 of FIG. 1.

FIG. 3 is a longitudinal cross-sectional view of the same embodiment, taken along section line 3—3 of FIG. 1.

FIG. 4 is a plan view of a portion of the inlet end of the first embodiment.

FIG. 5 shows a plan view of a portion of the inlet end of an alternate embodiment of the present invention, similar in aspect to FIG. 4, though illustrating the use of slot-shaped flow passages.

DESCRIPTION OF THE PREFERRED EMBODIMENTS

Figure 1:
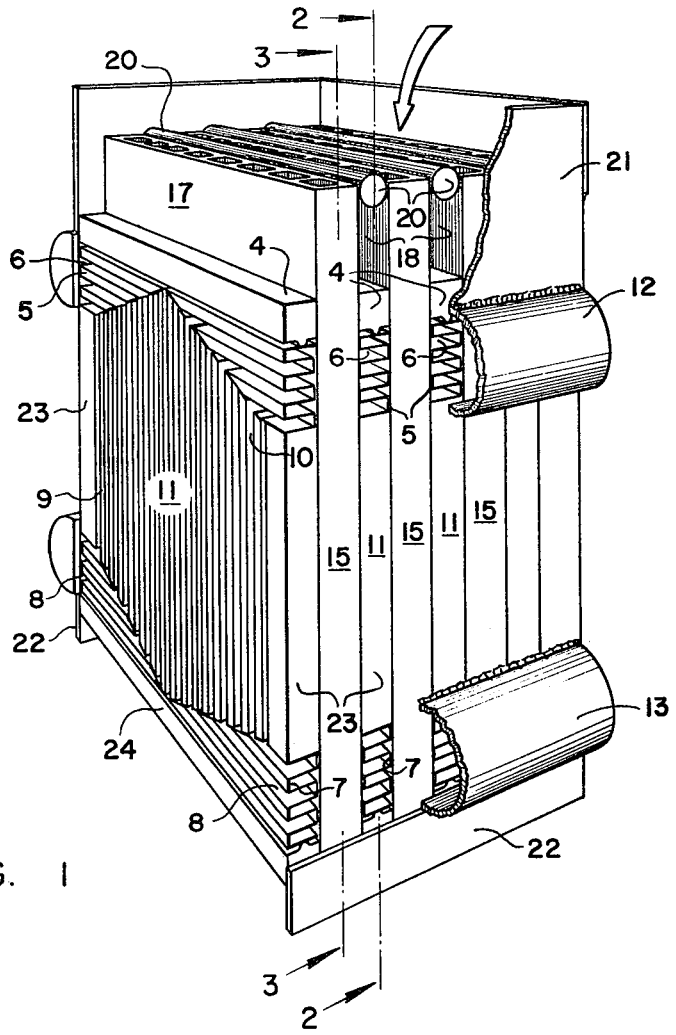
FIG. 1 is a perspective view of one embodiment of the present invention, partially cut away, wherein alternating layers of extruded sections and formed fin layers are illustrated.

Turning now to FIGS. 1–4, a first embodiment of the applicant's invention is shown in which first means define layers 11 comprising in part, formed fins 5, 7, and 9, alternating with second means defining layers 15 comprising rectangular shaped flow passages 14. Flow passages 14 may be integrally formed of extruded sections of generally planar shape, reference FIGS. 1, 3, and 4. It should be noted that while extrusions are illustrated as being integrally formed, such extruded sections may be sealingly joined together at their open ends or at their edges by brazing or by welding, to produce layers 15 of flow passages 14 having other dimensions of length and width than illustrated in the drawings.

In the first embodiment, the formed fins, 5, 7, and 9 are assembled as shown and joined to the generally planar exterior surfaces of layers 15 by brazing. The edges of each formed fin layer 11 comprising flow passages 6, 8, and 10 are sealed by bars 23, which are brazed to the generally planar surfaces of layers 15 near their edges. In a similar manner, bars 24 are brazed to layers 15 to seal the ends of each layer defining flow passages 6, 8, and 10. Likewise, bars 4 are brazed to layers 15 to seal the other ends of each layer 11 of flow passages 6, 8, and 10; however, bars 4 are so positioned that layers 15 extend substantially beyond the heat exchange area defined by layers 11.

Each layer 15 comprising flow passages 14 is therefore in physical and thermal contact with formed fins 5, 7, and 9 in the area bounded by bars 4, 23, and 24, such that heat is transferred between two separate fluids flowing through the heat exchanger in a manner hereinafter described. The two fluids are prevented from mixing and are contained within the subject heat exchanger by the structural integrity of layers 15 and by the sealed boundaries represented by bars 4, 23, and 24.

To explain the operation of the first embodiment, one of the fluids, in practice a refrigerant fluid, flows from distribution manifold means 12, through flow passages 6 defined by formed fins 5, and thence through flow passages 10 defined by formed fins 9. Thereafter, the same fluid flows out through flow passages 8 defined by formed fins 7 and into collection manifold means 13. Distribution manifold means 12 and collection manifold means 13 are sealingly brazed or welded to the edges of layers 15 and bars 4, 23, and 24, reference FIGS. 1–3.

The other of the two fluids, e.g., salt water, is directed into the flow passages 14 at the extended portion, inlet 17, by flange means 21. The salt water flows through passages 14 and exits the heat exchanger through outlet means 22. Flange means 21 and outlet means 22 are welded around the perimeter of each end of the subject heat exchanger above distribution manifold means 12 and below collection manifold means 13 respectively, reference FIGS. 1–3, and thereby sealingly confine the salt water to flow through passages 14.

Round filler bars 20 are welded between adjacent layers 15 at their extended ends, in a manner to sealingly exclude the salt water from contact with brazed joints at bars 4. This is important because salt water is generally more corrosive toward brazed joints than it is to welded joints. The layers 15 extend beyond the heat exchange area bounded by bars 4 sufficiently far to provide adequate length to dissipate the entrance turbulence of salt water entering passages 14. The rounded surface of filler bars 20 also reduces flow turbulence. Salt water flow is essentially laminar in that portion of flow passages 14 between bars 4 and bars 24. Erosion due to turbulent flow impingement of the salt water is primarily confined to extended inlet 17. Should a leak occur in extended inlet 17 of layer 15, due to flow erosion or due to corrosive action of the fluid flowing therein, mixing of the two fluids flowing through the heat exchanger is avoided. If a fluid leak should occur in the extended inlet 17, the leaking fluid would be confined to the volume 18, defined by round filler bars 20, flange means 21, bars 4, and by the generally planar sides of layers 15 of the extended inlet portion 17. Although the corrosive action of the leaking salt water may eventually broach the seal provided by bars 4 and mix with the fluid in flow passages 5, 8, and 10, the inlet portion 17 of layers 15 serves as a sacrificial structure to greatly extend the useful operating life of the heat exchanger.

Turning now to an alternate embodiment shown in FIG. 5, slot-shaped flow passages 16, open at each end, are defined by parting plates 27 and by spacer means 25 and 26. This structure is used in place of the extruded layers 15 of the first embodiment to convey a corrosive fluid, such as salt water, through the heat exchanger in heat transfer relationship with another fluid flowing through the layers 11 comprising formed fins 5, 7, and 9. The relative dimension of the slot-shaped flow passages 16 shown in FIG. 5 are for purposes of illustration, and are not critical to the practice of the invention. It may generally be observed that the straight, open ended structure embodied in slot-shaped flow passages 16 facilitates inspection and ease of cleaning, and offers minimal flow impedance.

Spacer means 25 and 26 are bars extending the length of flow passages 16, and are sealingly brazed or welded to alternate facing sides of parting plates 27. Spacer means 25 are used to support parting plates 27 at interior points, and to maintain an essentially equal distance spacing between the surfaces of adjacent parting plates 27, connected thereto. Spacer means 25 are used at the edges of parting plates 27 to form an edge seal for the layers 28 of slot-shaped flow passages 16, and to support and maintain spacing between the surfaces of adjacent parting plates 27, connected thereto. Formed fins, 5, 7, and 9, and bars 4, 23, and 24 are assembled as described above and brazed to the other sides of each parting plate 27, except on the outer parting plate surface 29.

Parting plates 27 and spacer means 25 and 26 extend beyond the heat exchange area of layer 11 to provide a sacrificial inlet structure 19, functionally operative as described above for inlet 17, as a means to extend the useful operating life of the heat exchanger. Round filler bars 20 are welded to the ends of extended parting plates 27 to sealingly exclude a fluid flowing through slot-shaped flow passages 15 from coming in contact with brazed joints at bars 4, and to reduce flow turbulence. Flange means 21 are sealingly welded around the perimeter of inlet 19 to direct the fluid flow therein.

In operation, the alternate embodiment functions in essentially the same manner as described above for the first embodiment. A refrigerant fluid flows from distribution manifold means 12, through the formed fin flow passages 6, 8, and 10, and into collection manifold means 13. The other fluid, such as salt water, flows into passages 15 at inlet 19, directed by flange means 21, and thereafter flows through the heat exchanger, exiting through outlet means 22.

It is anticipated that both embodiments of the subject plate type heat exchanger will be constructed of material having good heat transfer characteristics, specifically of aluminum or aluminum alloy, by assembling the layers in a jig and brazing in a salt bath or furnace as is well known to those skilled in the art. It is further anticipated that the applicant's invention will be used to transfer heat between a refrigerant fluid flowing through the formed fin flow passages 6, 8, and 10, such as ammonia or liquified natural gas, and salt water flowing through the passages 14 or 16. It should be apparent that the subject invention may also provide means for heat transfer between other fluids than these; however, its design is specifically predicated upon minimizing certain problems associated with the use of a brazed aluminum plate type heat exchanger in a salt water environment, as should be understood from the foregoing explanation and drawings.

As illustrated in the drawings, formed fins 5 define flow passages 6 at each side of the heat exchanger, at right angles to the flow passages defined by formed fins 9. It should be understood, however, that the present invention can be constructed with distribution manifold means 12 disposed on only one side of the heat exchanger, and with flow passages 6 being extended toward bars 23 at the opposite edge. Fluid flow would thereby enter from only one side and be distributed across the entire width of the heat exchanger, into flow passages 10. Likewise, the present invention could be constructed with collection manifold means 13 disposed at only one side of the heat exchanger, with similar modifications of flow passages 7.

The direction of fluid flow through the passages 10 is illustrated as being parallel to the direction of flow of salt water through passages 14 or 16. The flow direction could, however, easily be changed to provide for counterflow through passages 10 by interchanging the relative relationship of distribution manifold means 12, and collection manifold means 13. More extensive modification of distribution manifold means 12, collection manifold means 13, and flow passages 6, 8, and 10 could provide means to effect a cross-flow pattern.

While the invention has been described with respect to a preferred embodiment, it is to be understood that modifications thereto will be apparent to those skilled in the art within the scope of the invention, as defined in the claims which follow.

I claim:

1. A plate type heat exchanger for transferring heat between two fluids of differing temperature comprising (a) first means for defining a plurality of flow passages through the heat exchanger for one of said fluids, said flow passages being configured in a plurality of generally planar layers;

(b) second means for defining a plurality of flow passages through the heat exchanger for the other of said fluids, said flow passages being configured in a plurality of generally planar layers in alternating relationship with the generally planar layers of flow passages defined by said first means, and which on at least one end, extend substantially beyond the flow passages defined by said first means, said first and second means separating said fluids one from the other in heat exchange relationship;

(c) distribution manifold means for distributing the one of said fluids into the flow passages defined by said first means;

(d) collection manifold means for collecting the one of said fluids exiting the flow passages defined by said first means;

(e) inlet means for channeling the other of said fluids into the flow passages defined by said second means at the one end extending substantially beyond the flow passages defined by said first means; said inlet means including means for sealing the extending ends of the flow passages of adjacent generally planar layers defined by said second means, such that any leak occuring in the extending ends or in said inlet means does not result in the mixing of said fluids, and wherein said sealing means include filler bar means having a rounded surface in contact with the other of said fluids, for reducing flow turbulence in said inlet means; and (f) outlet means for collecting the other of said fluids exiting the flow passages defined by said second means.

2. The plate type heat exchanger of claim 1 wherein said sealing means further include welded joints.

3. A plate type heat exchanger for transferring heat between two fluids of differing temperature comprising (a) first means for defining a plurality of flow passages through the heat exchanger for one of said fluids, said flow passages being configured in a plurality of generally planar layers;

(b) second means for defining a plurality of flow passages through the heat exchanger for the other of said fluids and comprising integral extruded sections wherein the flow passages are formed with smoothly rounded internal corners to minimize corrosion and flow erosion and to simplify cleaning, said flow passages being configured in a plurality of generally planar layers in alternating relationship with the generally planar layers of flow passages defined by said first means, and which on at least one end, extend substantially beyond the flow passages defined by said first means, said first and second means separating said fluids one from the other in heat exchange relationship;

(c) distribution manifold means for distributing the one of said fluids into the flow passages defined by said first means;

(d) collection manifold means for collecting the one of said fluids exiting the flow passages defined by said first means;

(e) inlet means for channeling the other of said fluids into the flow passages defined by said second means at the one end extending substantially beyond the flow passages defined by said first means;

(f) outlet means for collecting the other of said fluids exiting the flow passages defined by said second means.

4. A plate type heat exchanger for transferring heat between two fluids of differing temperature comprising (a) first means for defining a plurality of flow passages through the heat exchanger for one of said fluids, said flow passages being configured in a plurality of generally planar layers;

(b) second means for defining a plurality of flow passages through the heat exchanger for the other of said fluids, comprising flat plates having a plurality of spacers for maintaining an essentially equadistant spacing between adjacent plates and forming the flow passages with a generally slot-like shape and with smooth sides to minimize corrosion and flow erosion, and to simplify cleaning, said flow passages being configured in a plurality of generally planar layers in alternating relationship with the generally planar layers of flow passages defined by said first means, and which on at least one end, extend substantially beyond the flow passages defined by said first means, said first and second means separating said fluids one from the other in heat exchange relationship;

(c) distribution manifold means for distributing the one of said fluids into the flow passages defined by said first means;

(d) collection manifold means for collecting the one of said fluids exiting the flow passages defined by said first means;

(e) inlet means for channeling the other of said fluids into the flow passages defined by said second means at the one end extending substantially beyond the flow passages defined by said first means;

(f) outlet means for collecting the other of said fluids exiting the flow passages defined by said second means.

5. The plate type heat exchanger of claims 1, 3, or 4 wherein the one fluid is a refrigerant fluid and the other fluid is salt water.

6. The plate type heat exchanger of claim 5 wherein said generally planar layers defined by said first and second means are aluminum or aluminum alloy.

7. The plate type heat exchanger of claims 1, 3, or 4 wherein said inlet means include flange means for directing the other of said fluids into said inlet means.

* * * * *